US006802192B2

(12) United States Patent
Morita et al.

(10) Patent No.: US 6,802,192 B2
(45) Date of Patent: Oct. 12, 2004

(54) STITCH CONTROL DEVICE IN FLAT KNITTING MACHINE

(75) Inventors: Toshiaki Morita, Wakayama (JP); Ikuhito Hirai, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/470,061

(22) PCT Filed: Jan. 24, 2002

(86) PCT No.: PCT/JP02/00530

§ 371 (c)(1),
(2), (4) Date: Jul. 24, 2003

(87) PCT Pub. No.: WO02/061190

PCT Pub. Date: Aug. 8, 2002

(65) Prior Publication Data

US 2004/0083765 A1 May 6, 2004

(30) Foreign Application Priority Data

Jan. 30, 2001 (JP) ..... 2001-022112

(51) Int. Cl.[7] ..... D04B 15/36

(52) U.S. Cl. ..... 66/78

(58) Field of Search ..... 66/27, 54, 77, 66/78, 64, 60, 70

(56) References Cited

U.S. PATENT DOCUMENTS

| | | | | |
|---|---|---|---|---|
| 4,996,853 A | * | 3/1991 | Brega | 66/27 |
| 5,284,032 A | | 2/1994 | Shima | |
| 5,495,728 A | | 3/1996 | Schmid et al. | |
| 6,158,251 A | * | 12/2000 | Sangiacomo | 66/27 |

FOREIGN PATENT DOCUMENTS

| | | |
|---|---|---|
| JP | 9-78415 | 3/1997 |
| JP | 2614538 | 5/1997 |

* cited by examiner

*Primary Examiner*—Danny Worrell
(74) *Attorney, Agent, or Firm*—Wenderoth, Lind & Ponack, L.L.P.

(57) ABSTRACT

In a loop length controller for a flat knitting machine adapted to set a loop length of a knitting fabric by raising or lowering, via a raising and lowering device, a stitch cam attached to a carriage that slides on a needle bed to slidably operate knitting needles forward and backward, the raising and lowering device is provided with a driving motor and a converting mechanism for converting rotational motion of the driving motor into ascent and descent of the stitch cam, wherein the converting mechanism is configured such that the ascending and descending amount of the stitch cam with respect to the rotational amount of the driving motor differs between a side for a larger drawing-in amount of knitting needles for loops of longer length and a side for a smaller drawing-in amount of knitting needles for loops of shorter length.

2 Claims, 6 Drawing Sheets

STITCH CONTROL DEVICE IN FLAT KNITTING MACHINE

This application is a National Stage of International Application No. PCT/JP02/00530, filed Jan. 24, 2002.

TECHNICAL FIELD

The present invention relates to a controller for setting a loop length in a flat knitting machine.

BACKGROUND ART

As this type of stitch controller for a flat knitting machine, there has been known the one described in, for example, Japanese Examined Patent Application Publication No. 6-94618 previously proposed by the present applicant.

According to this previously proposed stitch controller, as shown in FIG. 6 of the publication, a stitch cam of a carriage that slides on a needle bed to slide a knitting needle forward and backward is operated by oscillating the stitch cam, which is connected to a distal end of an operating lever. The operating lever is oscillated up and down by virtue of a spiral cam groove of a stitch cam operating cam attached to an output shaft of a driving motor. The spiral cam groove of the stitch cam operating cam is configured such that a spacing from a center of the stitch cam operating cam is proportional to a rotational angle of the stitch cam operating cam, and an ascending and descending amount of the stitch cam is also proportional to the rotational angle of the stitch cam operating cam, as indicated by a two-dot chain line B in FIG. 4.

FIG. 1 in the publication shows that the operating lever is oscillated by a stitch cam operating cam equipped with spiral threads.

A loop length available in one knitting machine is roughly decided by a gauge indicating the number of stitches per inch.

For example, in the case of a 16-gauge knitting machine, an interval (pitch) between adjacent needles is 1.5875 mm. In the case of an 8-gauge knitting machine, the pitch between adjacent knitting needles is 3.175 mm.

A sinker is provided between individual knitting needles of a needle bed, and an inter-sinker pitch is equal to an inter-needle pitch.

There are sinkers on both sides of a knitting needle, and a loop length is decided by how far a knitting needle is drawn in by a stitch cam.

Once a gauge is decided, the pitch is decided accordingly. If, therefore, a knitting machine is designed to provide a stitch cam drawn-in amount that exceeds an appropriate range, then sizes of loop length and yarn sizes will not match, thereby making it unsuitable as a product. Thus, only yarns of sizes in a range suited for pitches can be used for making knitted fabrics.

Accordingly, in general knitting machines, drawn-in amounts of stitch cams are set within an appropriate range for gauges. At the gauges, a bottom elastic or the like, for example, is knitted with loops of short length, while plaited patterns, such as a cable-stitch pattern, are knitted with loops of long length.

Recently, however, there has been an increasing demand for "seamless knit" that saves a sewing step after a knitting step, and also features improved fashionableness. For making the seamless knit, a tubular sweater having a front body and a back body are joined on sides by a single knitting machine provided with needle beds at its front and back. To respond to demand, seamless knits are made by performing skipped needle knitting in which every other knitting needle of the needle beds are used, with skipped needles being used for transferring stitches to knit the fabric. Skipped-needle knitting is performed as described below.

For example, to knit a seamless sweater by performing skipped-needle knitting using a 16-gauge knitting machine, a pitch between knit stitches will be double a standard pitch. More specifically, a stitch pitch will be 8 gauges, and a drawn-in amount of a stitch cam must be increased to obtain an 8-gauge knit fabric.

The spiral cam groove of the foregoing stitch cam operating cam is designed such that an ascending and descending amount of the stitch cam is proportional to the rotational angle of the stitch cam operating cam. Hence, skipped-needle knitting can be implemented simply by increasing a drawn-in amount; however, there is a problem in that a displacement amount of the stitch cam per step in 16-gauge knitting is basically large, thereby making it impossible to make finer adjustment of loop length.

As a solution, a step motor having a higher resolution could be used as a driving motor, while using the conventional cam design. This, however, leads to a problem of higher manufacturing cost because a step motor is expensive.

Especially, a cam assembly of a knitting machine uses many driving motors. For instance, in a 3-cam knitting machine for making three courses by one travel of a carriage over a needle bed, right and left step motors are provided for one knitting unit, meaning that 3 cams × two (right and left) × front and rear carriages =12 step motors being necessary. The knitting machine described in the above publication would require six step motors as well as drivers therefor.

The present invention has been proposed in view of the above problems, and it is an object of the invention to make it possible to provide a loop length controller in a flat knitting machine that permits highly accurate loop length control for knitting with a standard gauge, and also permits satisfactory loop length control in a skipped-needle knitting mode without causing an increase in manufacturing cost.

SUMMARY OF THE INVENTION

To fulfill the above object, a loop length controller in a flat knitting machine in accordance with the present invention is designed to set a loop length of a knitting fabric by raising or lowering, via a raising and lowering device, a stitch cam attached to a carriage that slides on a needle bed to slidably operate knitting needles forward and backward, with the raising and lowering device comprising a driving motor and a converting mechanism for converting a rotational motion of the driving motor into ascent and descent of a stitch cam, wherein the converting mechanism is configured such that an ascending and descending amount of the stitch cam with respect to the rotational amount of the driving motor differs between a side for a larger drawing-in amount of knitting needles for loops of longer length and a side for a smaller drawing-in amount of knitting needles for loops of shorter length.

Furthermore, the converting mechanism is equipped with an operating lever having one end thereof pivotally supported by a bottom board and another end thereof connected to a stitch can slidably guided by a raising and lowering slide slot, and a stitch cam operating cam (operating cam) provided on an output shaft of the driving motor, wherein the operating lever has an engaging portion, and the stitch cam operating cam comprises a spiral track that slidably engages with the engaging portion. The track is shaped such that the ascending and descending amount of the stitch cam with respect to the rotational amount of the driving motor is larger for a side for a larger drawing-in amount of knitting needles, while the ascending and descending amount of the stitch cam with respect to the rotational amount of the driving motor is smaller for a side for a smaller drawing-in amount of knitting needles.

DETAILED DESCRIPTION OF THE PREFERRED EMBODIMENTS

The following will describe an embodiment related to a loop length controller in a flat knitting machine of the present invention in conjunction with the accompanying drawings.

Figure 1:
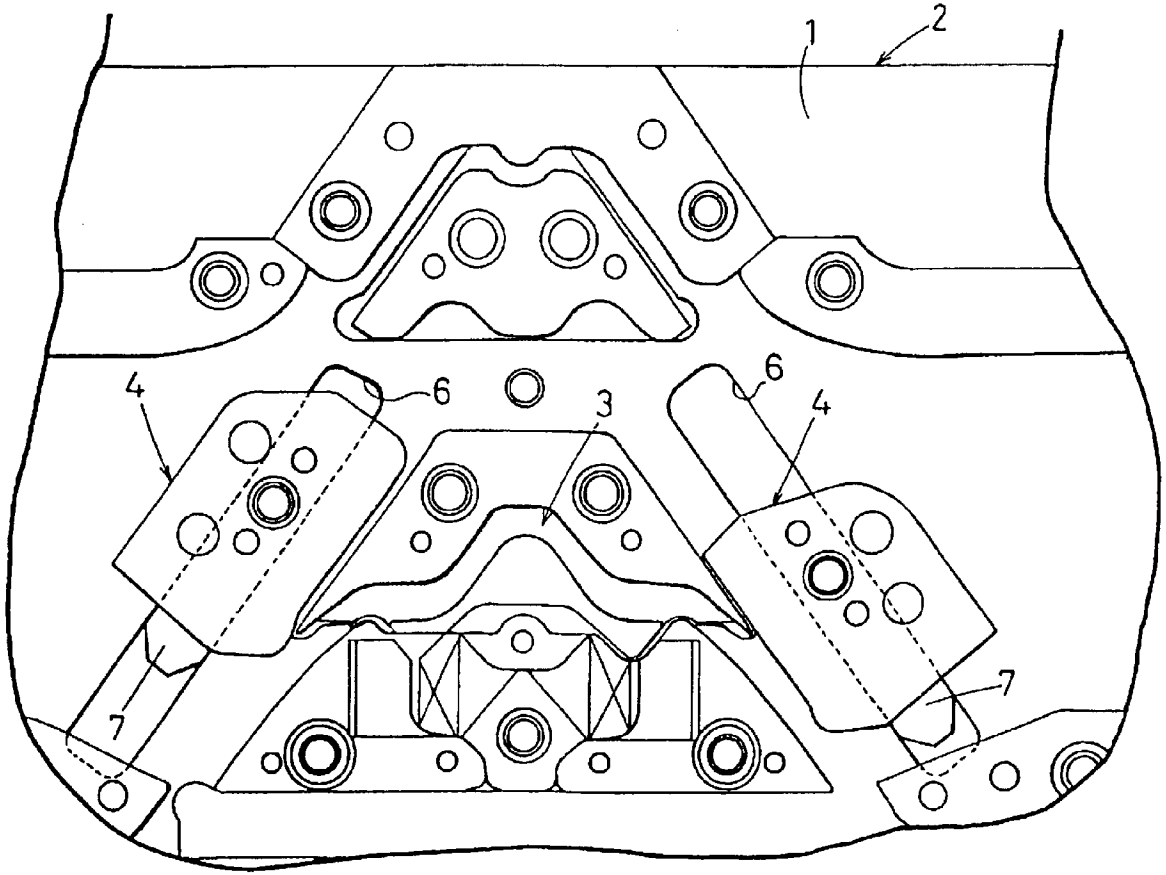
FIG. 1 is a bottom view of a stitch cam portion of a carriage related to a loop length controller in a flat knitting machine in accordance with the present invention.

FIG. 1 shows a group of cams of a carriage 2 provided on a bottom board 1, observed from beneath the bottom board. Stitch cams 4 and 4 are provided on both sides of a rasing cam 3, respectively, wherein the stitch cams 4 and 4 are provided with raising and lowering device 5 and 5 for raising and lowering the stitch cams, respectively, which will be discussed hereinafter.

The stitch cams 4 and 4 and the raising and lowering device 5 and 5 are disposed substantially linearly symmetrical, and have the same mechanism. Hence, one of the raising and lowering device 5 will be explained.

Figure 2:
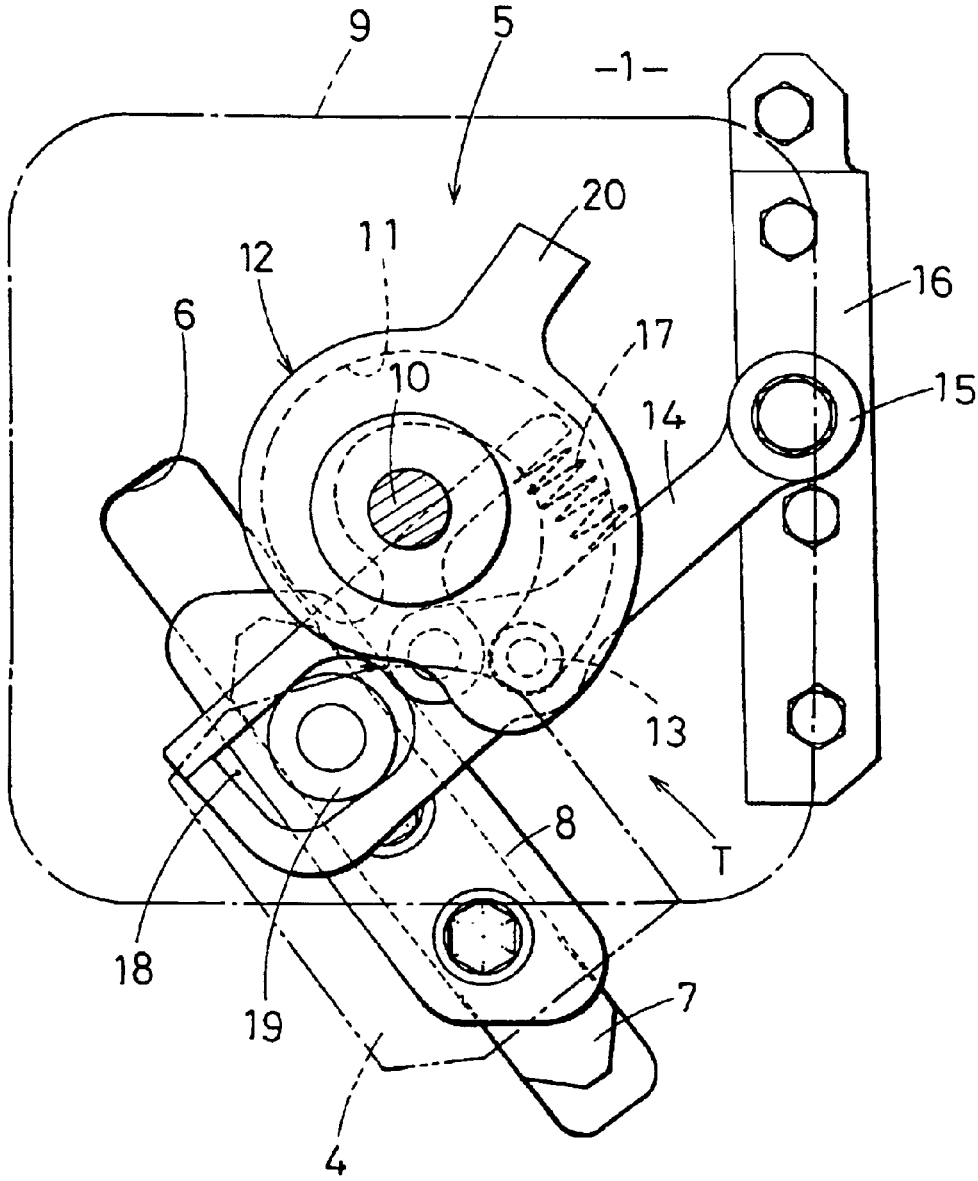
FIG. 2 is a top plan view of the stitch cam portion of the carriage related to the loop length controller in the flat knitting machine in accordance with the present invention.

First, as shown in FIG. 1 and FIG. 2, a vertically diagonal raising and lowering slide slot 6 is drilled in the bottom board 1. A sliding member 7 is slidably fitted into the raising and lowering slide slot 6, wherein the stitch cam 4 is located on a bottom surface thereof with the sliding member 7 sandwiched therebetween, while a holding plate 8 is secured on a top surface thereof integrally with the sliding member 7, so that the stitch cam 4 slides up and down along the raising and lowering slide slot 6.

Next, as shown in FIG. 2, the raising and lowering device 5 is constructed of a driving motor 9, a stitch cam operating cam 12 (operating cam) provided with a spiral cam groove (track) 11 which is attached to an output shaft 10 of the driving motor 9 and which will be discussed hereinafter, and an operating lever 14 oscillated by an engaging portion 13 that engages with the spiral cam groove 11. The spiral cam groove 11 and the operating lever 14 provided with the engaging portion 13, that slides by being guided by the cam groove 11, constitute a converting mechanism T.

The operating lever 14 is pivotally supported by a bracket 16 having a proximal end portion 15 mounted on the bottom board 1, has an engaging portion composed of a roller at a position near its middle, and has a long hole 18 at its distal end, with the long hole 18 being closed by a spring 17.

A stopper projection 19 formed of a roller vertically provided on a top surface of the holding plate 8 is fitted in the long hole 18.

Furthermore, the stitch cam operating cam 12 is provided with a horn-shaped lug 20. When a proximity sensor (not shown) provided on the bottom board 1 detects the lug 20, it is regarded as position 0 and the driving motor 9 is stopped.

Figure 3:
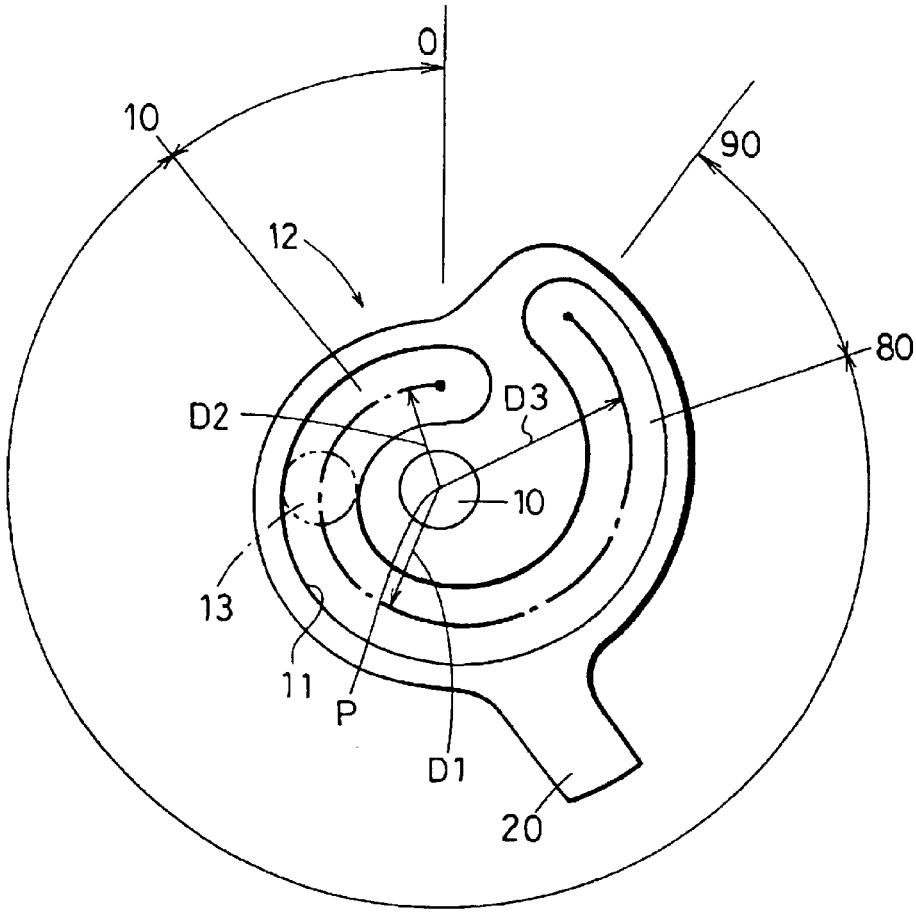
FIG. 3 is a bottom view of a stitch cam operating cam related to the loop length controller in the flat knitting machine in accordance with the present invention.

As shown in FIG. 2 and FIG. 3, the spiral cam groove 11 formed in the stitch cam operating cam 12 is convolutionally formed over about 330 degrees around the output shaft 10 of the driving motor 9.

At starting end position 0 where the proximity sensor detects the lug 20, the engaging portion 13 engaged with the spiral cam groove 11 reaches a position closest to the output shaft 10 of the driving motor 9. In other words, the stitch cam 4 rises to a highest point, thereby forming loops of a shortest length.

At a terminating end position (the state shown in FIG. 2 and a position at 90 on the axis of abscissa shown in FIG. 4), the engaging portion 13 engaged with the cam groove 11 is at a farthest position from the output shaft 10 of the driving motor 9. In other words, the stitch cam 4 lowers to a lowest point, thereby forming loops of a longest length. The cam groove 11, however, is shaped such that an ascending and descending amount of the stitch cam 4 with respect to a rotational amount of the driving motor 9 is not proportional during travel from a starting end to a terminating end.

The shape of the cam groove 11 will now be explained in conjunction with FIG. 3 and FIG. 4.

Figure 4:
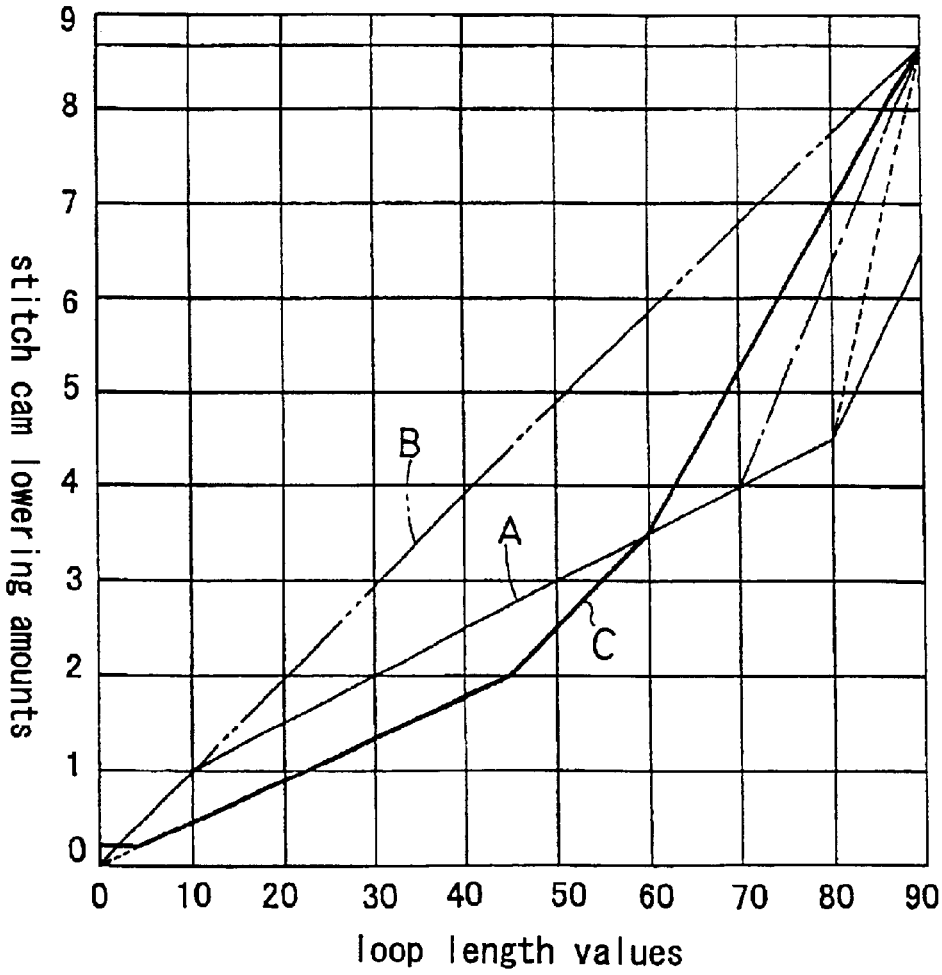
FIG. 4 is a graph showing a relationship between loop length values and stitch cam descending amounts of the loop length controller in the flat knitting machine in accordance with the present invention.

FIG. 4 is a graph showing a relationship between loop length values (corresponding to rotational amounts of the driving motor 9) and stitch cam lowering amounts in a 16-gauge flat knitting machine used for knitting a seamless sweater by performing skipped-needle knitting. The axis of abscissa indicates the loop length values, while the axis of ordinate indicates the stitch cam lowering amounts. The cam groove 11 of the embodiment is denoted by A in the figure.

As shown in FIG. 3 and by A in FIG. 4, a proportion D1 at which the spiral cam groove 11 moves away from an axial center P of the output shaft 10 when the output shaft 10 of the driving motor 9 turns from loop length value 10 to loop length value 80 is set to provide a gentler slope than that of at a proportion D2 at which the spiral cam groove 11 moves away from an axial center P of the output shaft 10 when the output shaft 10 turns from loop length value 0 to loop length value 10, or a conventional straight line indicated by B in FIG. 4.

The gentler slope is set for the output shaft 10 of the driving motor 9 to revolve from loop length value 10 to value 80, as compared with the conventional straight line indicated by B in FIG. 4 or remaining portions for the following reason. In a range of loop length values from 10 to 80, loops of shorter length are formed at values in the vicinity of 10 when knitting at 16 gauge, while loops of longer length are formed at values in the vicinity of 80 when knitting at 8 gauge. Hence, the above gentler slope is set to permit relatively fine adjustment to be made for any cases within the aforesaid range.

Furthermore, for loop length values 80 to 90, a proportion D3 at which the spiral cam groove 11 moves away from the axial center P of the output shaft 10 is set to have a larger rate of change than that of proportion D2, thereby forming a steep slope, as shown in FIG. 4. This allows the stitch cam 4 to be drawn down to a maximum of a lowering amount usually used when a 16-gauge flat knitting machine is used as an 8-gauge flat knitting machine by performing skipped-needle knitting.

When applying a rate of change for the range from loop length values 80 to 90 to a flat knitting machine used as an 8-gauge model, the stitch cam 4 can be further drawn down beyond the aforesaid maximum of the lowering amount usually used by setting a larger proportion of the stitch cam lowering amount with respect to loop length values, as indicated by, for example, the dashed line or the one-dot chain line in FIG. 4.

Even if the rate of change in the vicinity of the maximum stitch cam lowering amount is increased when the flat knitting machine is used as the 8-gauge model, the loop length is still longer at 8 gauge than at 16 gauge, so that a difference caused by a slight increase in a displacement amount of the stitch cam 4 will not show in knitted fabric.

As indicated by reference character C in FIG. 4, proportion of the stitch cam lowering amount with respect to the loop length values may be changed at two places in the vicinities of loop length values 45 and 60 so as to be formed of three straight lines having different slopes, or may be easily changed in a second order curve simply by changing the spiral shape of the cam groove 11, although this is not shown.

Figure 5:
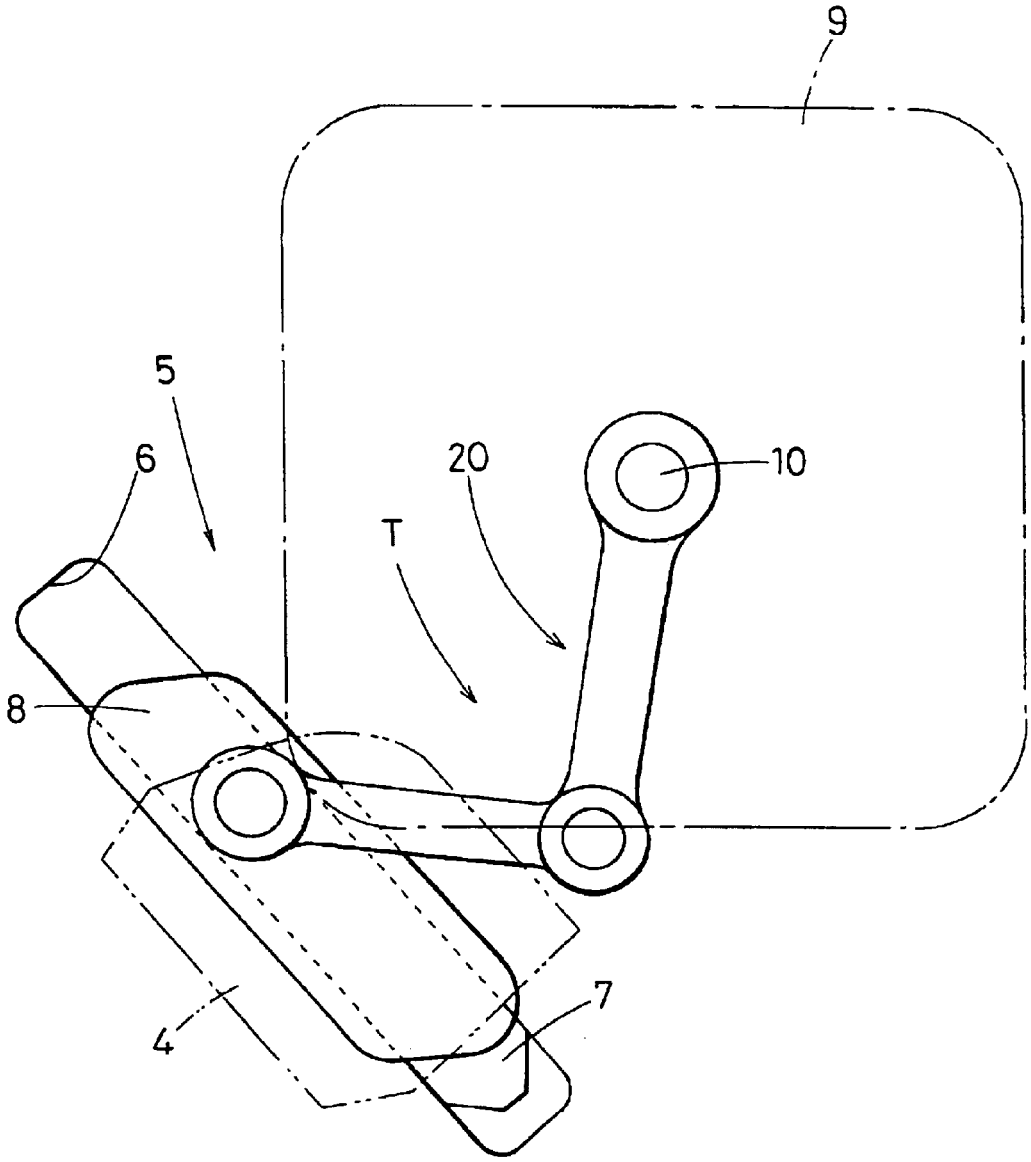
FIG. 5 is a schematic top plan view showing another embodiment of a raising and lowering device related to the loop length controller in the flat knitting machine in accordance with the present invention.
Figure 6:
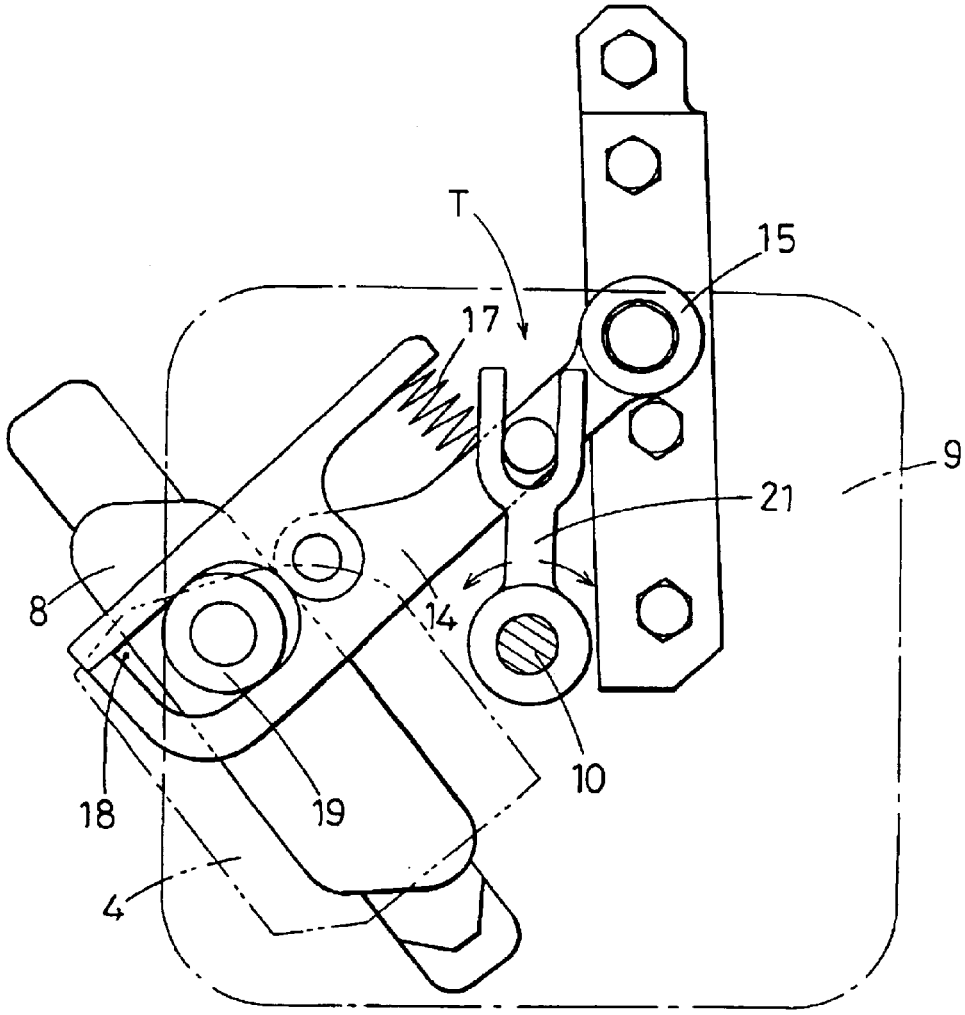
FIG. 6 is a schematic top plan view showing still another embodiment of the raising and lowering device related to the loop length controller in the flat knitting machine in accordance with the present invention.

Furthermore, the raising and lowering device 5 in the above embodiment is constructed of the driving motor 9, the stitch cam operating cam 12 having the spiral cam groove 11 that is attached to the output shaft 10 of the driving motor 9, and the operating lever 14 having the engaging portion 13 engaged with the helical cam groove 11 to be oscillated; alternatively, however, a link type device as shown in FIG. 5 and FIG. 6 may be used.

In raising and lowering device 5 shown in FIG. 5 and FIG. 6, a ratio of the stitch cam lowering amount with respect to loop length values changes in the second order curve. In the raising and lowering device 5 shown in FIG. 5, output shaft 10 of driving motor 9 and holding plate 8 of stitch cam 4 are connected by a jointed link 20 to form a converting mechanism T.

In raising and lowering device 5 shown in FIG. 6, an operating lever 14, having a proximal end portion 15 thereof pivotally supported by bottom board 1 and a distal end portion thereof connected to holding plate 8 of stitch cam 4, is operated by an operating stick 21 oscillated by driving motor 9 so as to form converting mechanism T.

In the embodiment described above, a so-called "double gauge" in which a 16-gauge flat knitting machine is used for 8-gauge knitting by performing skipped-needle knitting has been taken as an example; the present invention, however, is not limited thereto.

In addition, according to the above embodiment, spiral cam groove 11 forms a track for oscillating the operating lever 14. The spiral cam groove 11 may be replaced by, for example, a protuberant line shown in FIG. 1 of Japanese Examined Patent Application Publication No. 6-94618 previously proposed by the present applicant.

Furthermore, it is needless to say that the present invention can be implemented by using a curve for the "riding slope surface of the control track" in, for example, Japanese Patent No. 2566200.

INDUSTRIAL APPLICABILITY

As explained above, a loop length controller in a flat knitting machine according to the present invention is constructed such that an ascending and descending amount of a stitch cam with respect to a rotational amount of a driving motor differs between a side where a drawn-in amount of knitting needles is large to form loops of longer length and a side where a drawn-in amount of knitting needles is small to form loops of shorter length. Hence, fine adjustment can be made in standard knitting portions frequently used in knitting, and in addition, loop length can be adjusted also in a portion where a loop length exceeds that of loops of a shortest length or in the vicinity of loops of a longest length.

For instance, an ascending and descending amount of a stitch cam with respect to rotational amount of a driving motor can be changed simply by changing a shape or the like of a spiral track. For a longer loop, adjustment can be accomplished by increasing an increasing ratio of displacement of a stitch cam to a rotational angle of a stitch cam operating cam without need for increasing resolution of a stitch cam control motor. For a shorter loop, fine adjustment can be made, while an adjustment range can be expanded for longer loops to permit an extended maximum loop length. This arrangement advantageously obviates a need for using an expensive step motor exhibiting a higher resolution, thereby making it possible to prevent an increase in a manufacturing cost due to the expensive step motor.

What is claimed is:

1. A loop length controller, for a flat knitting machine, adapted to set a loop length of a knitting fabric by raising or lowering a stitch cam attached to a carriage that is to slide on a needle bed for slidably operating knitting needles forward and backward, said loop length controller comprising:

a raising and lowering device for raising and lowering the stitch cam, said raising and lowering device including (i) a driving motor, and (ii) a converting mechanism for converting rotational movement of said driving motor into ascent and descent of the stitch cam, said converting mechanism being constructed and arranged such that an amount the stitch cam ascends or descends with respect to rotational movement of said driving motor for a side corresponding to a larger drawing-in amount of the knitting needles, for producing loops of longer length, is different than an amount the stitch cam ascends or descends with respect to rotational movement of said driving motor for a side corresponding to a smaller drawing-in amount of the knitting needles, for producing loops of shorter length.

2. The loop length controller according to claim 1, wherein said converting mechanism includes (i) an operating lever having one end thereof pivotally supported by a bottom board and another end thereof connected to the stitch cam, which stitch cam is slidably guided by a slot in the bottom board, said operating lever also having an engaging portion, and (ii) an operating cam provided on an output shaft of said driving motor, said operating cam having a spiral track that slidably engages with said engaging portion, wherein said spiral track is shaped such that the amount the stitch cam ascends or descends with respect to rotational movement of said driving motor is larger for the side corresponding to the larger drawing-in amount of the knitting needles, and such that the amount the stitch respect to rotational movement of said driving motor is smaller for the side corresponding to smaller drawing-in amount of the knitting needles.

* * * * *